US008053074B2

(12) United States Patent
Miyamura et al.

(10) Patent No.: US 8,053,074 B2
(45) Date of Patent: Nov. 8, 2011

(54) STRETCH NONWOVEN FABRIC

(75) Inventors: Takeshi Miyamura, Tochigi (JP); Manabu Matsui, Tochigi (JP); Tetsuya Masuki, Tochigi (JP); Hideyuki Kobayashi, Tochigi (JP); Koji Kanazawa, Tochigi (JP); Hiroshi Kohira, Tochigi (JP)

(73) Assignee: Kao Corporation, Tokyo (JP)

( * ) Notice: Subject to any disclaimer, the term of this patent is extended or adjusted under 35 U.S.C. 154(b) by 213 days.

(21) Appl. No.: 12/302,776

(22) PCT Filed: May 18, 2007

(86) PCT No.: PCT/JP2007/060215

§ 371 (c)(1),
(2), (4) Date: Jan. 28, 2009

(87) PCT Pub. No.: WO2007/138887

PCT Pub. Date: Dec. 6, 2007

(65) Prior Publication Data

US 2009/0169802 A1 Jul. 2, 2009

(30) Foreign Application Priority Data

May 31, 2006 (JP) ..... 2006-152848
May 31, 2006 (JP) ..... 2006-156814

(51) Int. Cl.
*D02G 3/00* (2006.01)
*B65H 81/00* (2006.01)
*D04H 1/00* (2006.01)

(52) U.S. Cl. ..... 428/397; 428/213; 428/364; 428/365; 442/328; 442/329; 442/336; 442/381; 442/389; 442/409; 442/411; 156/161

(58) Field of Classification Search ..... 442/328, 442/329, 381, 389, 409, 411, 336; 428/364, 428/365, 213, 397; 156/161
See application file for complete search history.

(56) References Cited

U.S. PATENT DOCUMENTS 3,439,084 A * 4/1969 Hazime et al. ..... 264/167
(Continued)

FOREIGN PATENT DOCUMENTS

EP 1589140 A1 10/2005
(Continued)

OTHER PUBLICATIONS

European Search Report dated Mar. 3, 2010 in European Application No. 07743650.9.

(Continued)

*Primary Examiner* — Norca L Torres-Velazquez
(74) *Attorney, Agent, or Firm* — Birch, Stewart, Kolasch & Birch, LLP

(57) ABSTRACT

A stretch nonwoven fabric 10 contains inelastic fibers having a varied thickness along the length and elastic fibers. The nonwoven fabric 10 preferably includes an elastic fiber layer 1 and a substantially inelastic, inelastic fiber layer 2 on at least one side of the elastic fiber layer 1. The fibers with a varied thickness along the length are contained in the inelastic fiber layer 2. The nonwoven fabric 10 is conveniently produced by (a) superposing a web containing low-drawn, inelastic fibers having an elongation of 80% to 800% on at least one side of a web containing elastic fibers, (b) subjecting the webs, while in a non-united state, to through-air technique to obtain a fibrous sheet having the webs united together by thermal bonding the fibers at their intersections, and (c) stretching the fibrous sheet in at least one direction to draw the low-drawn inelastic fibers, followed by releasing the sheet from the stretch.

15 Claims, 4 Drawing Sheets

U.S. PATENT DOCUMENTS

| | | | | |
|---|---|---|---|---|
| 3,930,106 | A * | 12/1975 | Mihara et al. | 428/399 |
| 4,663,220 | A | 5/1987 | Wisneski et al. | |
| 5,385,775 | A | 1/1995 | Wright | |
| 6,730,390 | B1 | 5/2004 | Kobayashi et al. | |
| 2002/0037678 | A1 | 3/2002 | Ohata et al. | |
| 2003/0068489 | A1 | 4/2003 | Ohata et al. | |
| 2004/0067710 | A1 * | 4/2004 | Tsujiyama et al. | 442/329 |
| 2004/0121683 | A1 * | 6/2004 | Jordan et al. | 442/182 |
| 2004/0132374 | A1 * | 7/2004 | Kobayashi | 442/328 |

FOREIGN PATENT DOCUMENTS

| | | | |
|---|---|---|---|
| GB | 1557198 | A | 12/1979 |
| GB | 1558198 | | 12/1979 |
| JP | 4-11059 | A | 1/1992 |
| JP | 11-323715 | A | 11/1999 |
| JP | 2001-277393 | A | 10/2001 |
| JP | 2002-361766 | A | 12/2002 |
| JP | 2004-016559 | A | 1/2004 |
| JP | 2004-166831 | A | 6/2004 |
| JP | 2004-244791 | A | 9/2004 |
| JP | 2005-89870 | A | 4/2005 |
| JP | 2005-179843 | A | 7/2005 |
| WO | WO 92/16361 | A1 | 10/1992 |

OTHER PUBLICATIONS

Office Action dated Jul. 20, 2010 in Chineses Application No. 200780019922.5.

Official Communication from the European Patent Office dated Jun. 21, 2011, in European Application No. 07743650.9-2124.

Japanese Office Action dated Jul. 5, 2011 in Japanese Application No. 2006-152814.

* cited by examiner

STRETCH NONWOVEN FABRIC

TECHNICAL FIELD

The present invention relates to stretch nonwoven fabric.

BACKGROUND ART

An elastically stretchable composite sheet composed of an elastic sheet, which is formed of an elastically stretchable film or elastically stretchable continuous filaments, and a fiber aggregate having inelastic extensibility has been proposed in U.S. Pat. No. 6,730,390B1. The elastic sheet and the fiber aggregate are bonded to each other at discretely arranged bonds. The fibers making up the fiber aggregate are long fibers continuously extending between every adjacent bonds while describing irregular curves. The long fibers are independent of one another without being solvent welded nor thermally bonded between the bonds.

According to U.S. Pat. No. 6,730,390B1, because the long fibers of the fiber aggregate describe irregular curves between the bonds, the fiber aggregate does not interfere with the composite sheet stretch. However, since the long fibers of the fiber aggregate are independent of one another between the bonds, the elastically stretchable composite sheet has low strength against tension. The peel strength between the fiber aggregate and the elastic sheet is also low. Furthermore, the long fibers are liable to be raised between the bonds to cause a fuzzy appearance, which gives an unattractive impression.

Apart from the above described elastically stretchable composite sheet, various types of stretch nonwoven fabric containing elastic fibers made of elastomer resins are known. For example, U.S. Pat. No. 4,663,220A discloses an elastomeric nonwoven fabric including microfibers comprising an extrudable elastomeric composition containing at least about 10% by weight of an A-B-A block copolymer and a polyolefin. Containing a polyolefin, the microfibers cannot be designed to have sufficient stretch characteristics.

U.S. Pat. No. 5,385,775A proposes a composite elastic material which includes (1) an anisotropic elastic fibrous web having a layer of elastomeric meltblown fibers and a layer of elastomeric filaments and (2) a gatherable layer joined to the anisotropic elastic fibrous web. The material used to make the elastomeric filaments includes 40% to 80% by weight elastomeric polymer and 5% to 40% by weight resin tackifier. Containing a resin other than the elastomeric resin, the elastomeric filaments cannot be designed to have sufficient stretch characteristics.

JP 2002-361766A discloses a stretchable composite sheet including an elastic sheet formed of fiber or film containing 60% to 99% by weight of a styrene elastomer having a styrene content of 10% to 40% by weight and a number average molecular weight of 70,000 to 150,000. The fiber or film contains a material other than the styrene elastomer, such as an olefinic resin or an oil component. On account of the material other than the elastomeric material, the stretchable composite sheet cannot be designed to have sufficient stretch characteristics.

JP 4-11059A discloses a stretch nonwoven fabric formed of fibers of a styrene elastomer. The styrene elastomer is obtained by preparing a block copolymer composed of a styrene-based polymer block A and an isoprene-based polymer block B and hydrogenating the isoprene double bonds. The nonwoven fabric has a low modulus and cannot be regarded as having sufficient hysteresis of extension and retraction.

DISCLOSURE OF THE INVENTION

The present invention provides a stretch nonwoven fabric including elastic fibers and inelastic fibers. The inelastic fibers have a varied thickness along the length of the individual fibers.

The invention also provides a process of producing a stretch nonwoven fabric. The process includes the steps of superposing a web which contains low-drawn, inelastic fibers having an elongation of 80% to 800% on at least one side of a web which contains elastic fibers, applying hot air to the webs by through-air technique while the webs are in a non-united state to obtain a fibrous sheet having the webs united together by thermal bonding of the fibers at the fiber intersections, stretching the fibrous sheet in at least one direction to draw the low-drawn inelastic fibers, and releasing the fibrous sheet from the stretched state.

The invention also provides a process of producing a stretch nonwoven fabric, which includes the steps of applying hot air to a web which contains elastic fibers and low-drawn, inelastic fibers having an elongation of 80% to 100%, by through-air technique to obtain a fibrous sheet having the fibers thermally bonded to one another at their intersections, stretching the fibrous sheet in at least one direction to draw the low-drawn inelastic fibers, and releasing the fibrous sheet from the stretched state.

DETAILED DESCRIPTION OF THE INVENTION

Figure 1:
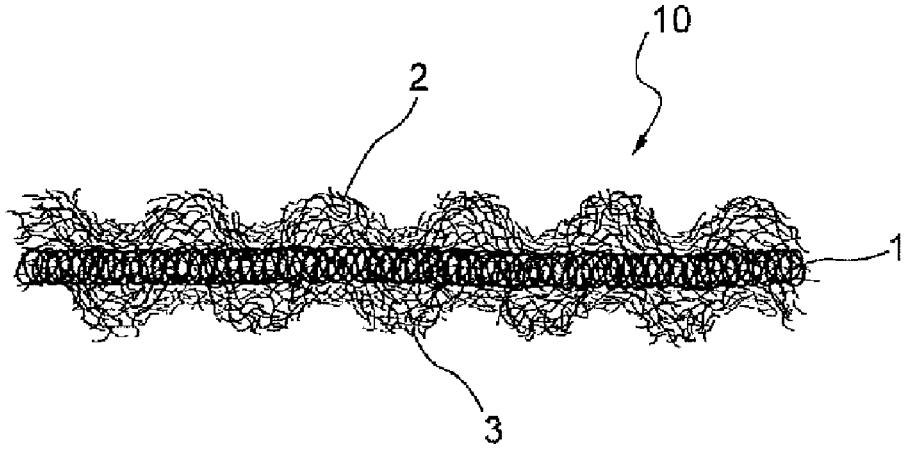
FIG. 1 is a schematic cross-section of an embodiment of the stretch nonwoven fabric according to the invention.

The present invention will be illustrated in detail based on its preferred embodiments with reference to the accompanying drawing. FIG. 1 is a schematic cross-section of an embodiment of the stretch nonwoven fabric according to the invention. A stretch nonwoven fabric 10 of the present embodiment is composed of an elastic fiber layer 1 and substantially inelastic, inelastic fiber layers 2 and 3, which may be the same or different, on respective sides of the elastic fiber layer 1. The nonwoven fabric having the inelastic fiber layer on both sides thereof is preferred to a nonwoven fabric having the inelastic fiber layer on one side thereof in terms of anti-blocking properties and handling properties.

The fibers that can be used to make the elastic fiber layer 1 include those made from thermoplastic elastomers or rubber. When the stretch nonwoven fabric of the present embodiment is produced by a through-air technique, fibers made of thermoplastic elastomers are preferred. This is because, for one thing, thermoplastic elastomers are melt-spinnable using an extruder in the same manner as ordinary thermoplastic resins. For another, the fibers thus obtained are easy to thermal bond. Examples of the thermoplastic elastomers include styrene elastomers such as SBS, SIS, SEBS, and SEPS, olefin elastomers, polyester elastomers, and polyurethane elastomers. These elastomers may be used either individually or in combination of two or more thereof. Sheath/core or side-by-side conjugate fibers composed of these resins are also useful. Fibers made from a styrene elastomer, an olefin elastomer or a combination thereof are particularly preferred in view of spinnability, stretch characteristics, and cost.

A resin containing a specific block copolymer as a thermoplastic elastomer is especially suited as a material making up the elastic fibers used in the elastic fiber layer 1. The stretch nonwoven fabric which contains the block copolymer has a higher modulus and a better extension-retraction hysteresis than a conventional stretch nonwoven fabric. Accordingly, the stretch nonwoven fabric containing the block copolymer exhibits satisfactory stretch characteristics even with a decreased amount of the elastic fibers and can therefore be designed to be thin, breathable, pleasant to the touch, easy to stretch, and moderately contractible. The block copolymer is characterized by having the following structure and dynamic viscoelastic properties.

The block copolymer includes a polymer block A derived predominately from an aromatic vinyl compound. Examples of the aromatic vinyl compound include styrene, p-methylstyrene, m-methylstyrene, p-tert-butylstyrene, a-methylstyrene, chloromethylstyrene, p-tert-butoxystyrene, dimethylaminomethylstyrene, dimethylaminoethylstyrene, and vinyltoluene. Styrene is preferred of them from an industrial viewpoint.

The content of the polymer block A in the block copolymer is preferably 10% to 50%, more preferably 15% to 30%, by weight. With the polymer block A content being in the range of 10% to 50% by weight, the block copolymer has satisfactory spinnability and heat resistance, and the block copolymer have good stretch characteristics and pliability.

The block copolymer includes a polymer block B derived predominately from a repeating unit represented by formula (1) shown below in addition to the polymer block A. The amount of the polymer block B in the block copolymer is the remainder other than the block A, i.e., preferably 50% to 90%, more preferably 70% to 85%, by weight.

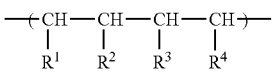

(1)

wherein one or two of $R^1$, $R^2$, $R^3$, and $R^4$represents or each represent a methyl group;

and the others each represent a hydrogen atom.

The polymer block B may further contain a repeating unit represented by formula (2) shown below in addition to the repeating unit of formula (1). The content of the repeating unit of formula (2) in the polymer block B is 20 mol % or less, preferably 10 mol % or less. The repeating unit of formula (2) is optional.

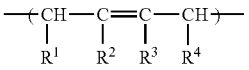

(2)

wherein $R^1$, $R^2$, $R^3$, and $R^4$ are as defined above.

There are several configurations that the polymer blocks A and B can take in the block copolymer. A triblock copolymer having an A-B-A configuration is preferred for providing good stretch characteristics.

It is preferred for the block copolymer having the above identified structure to have the following dynamic viscoelastic properties, so that the stretch nonwoven fabric containing the elastic fibers of the block copolymer has a higher modulus and a better extension-retraction hysteresis than a conventional stretch nonwoven fabric. To have a high modulus is advantageous for the stretch nonwoven fabric to retain satisfactory stretch characteristics even when it has a reduced basis weight to be thin or when in using elastic fibers with a reduced thickness so as to improve breathability and feel to the touch of the stretch nonwoven fabric. That is, the stretch nonwoven fabric having a high modulus easily stretches under tension and, on being released from the tension, contracts with a strong force. Accordingly, the stretch nonwoven fabric containing the elastic fibers of the block copolymer is especially suited for use as, for example, a sheet constituting the entire exterior surface of a pull-on disposable diaper.

Elastic fibers made from the block copolymer have another advantage of small tackiness compared with other general elastomeric fibers. This also contributes to improvement of the feel to the touch of the stretch nonwoven fabric.

The block copolymer preferably has a storage modulus G' of dynamic viscoelasticity of $1\times10^4$ to $8\times10^6$ Pa, more preferably $5\times10^4$ to $5\times10^6$ Pa, even more preferably $1\times10^5$ to $1\times10^6$ Pa, measured at 20° C. and a frequency of 2 Hz. The dynamic loss tangent tan δ of dynamic viscoelasticity of the block copolymer is preferably 0.2 or less, more preferably 0.1 or less, even more preferably 0.05 or less, at 20° C., 2 Hz. While a smaller tan δ is more desirable, the smallest value reachable by is the state of the art is about 0.005.

The storage modulus G' is an index of an elastic component of the block copolymer in the dynamic viscoelasticity measurement, i.e., an index of rigidity. On the other hand, the dynamic loss tangent tan δ is an index represented by the ratio of loss modulus G" to storage modulus G' (G"/G'), which is indicative of how much energy is absorbed when the block copolymer is deformed. As long as the block copolymer has a storage modulus G' in the range recited, the nonwoven fabric exhibits an appropriate modulus and an improved extension-retraction hysteresis and stretches without needing a large force. As a result, the nonwoven fabric feels good. Furthermore, the nonwoven fabric has a reduced residual strain. On the other hand, as long as the block copolymer has a dynamic loss tangent tank of the value described above or smaller, the nonwoven fabric has a reduced residual strain after stretch thereby exhibiting sufficient stretch characteristics.

As stated, dynamic viscoelasticity measurement of the block copolymer is made at 20° C. and 2 Hz in tensile mode. The strain applied is 0.1%. The measurement in the present embodiment was made on a 10 mm wide, 30 mm long and 0.8 mm thick plate-shaped specimen using Physica MCR500 (Anton Paar).

The block copolymer can be synthesized by, for example, the following steps. An aromatic vinyl compound and a conjugated diene compound are put in an appropriate order into a hydrocarbon solvent such as cyclohexane and anion-polymerized using an organolithium compound, metallic sodium, etc. as an initiator to obtain a copolymer having conjugated diene double bonds. Examples of the conjugated diene include 1,3-butadiene, isoprene, pentadiene, and hexadiene. Isoprene is preferred.

Hydrogenation of the conjugated diene double bonds of the resulting copolymer yields a desired block copolymer. The degree of hydrogenation of the conjugated diene double bonds is preferably 80% of higher, more preferably 90% or higher, in terms of heat resistance and weatherability. The hydrogenation reaction can be carried out in the presence of a noble metal catalyst such as platinum or palladium, an organonickel compound or an organocobalt compound, or a catalyst system composed of such an organometaltic compound and other organometallic compound. The degree of hydrogenation is calculated from the iodine value of the resulting block copolymer.

Commercially available block copolymers may be made use of. Examples of such products include SEPTON® 2004 and SEPTON® 2002, which are styrene-ethylene-propylene-styrene block copolymers available from Kuraray Co., Ltd.

In using the block copolymer as a resin component of the elastic fibers used to make the elastic fiber layer 1, the elastic fibers may be made solely of the block copolymer or may contain other resin(s). In the latter case, the block copolymer content in the elastic fibers is preferably 20% to 80%, more preferably 40% to 60%, by weight.

Melt-spinnable resins including polyolefin resins, e.g., polyethylene, polypropylene, and propylene-ethylene copolymers, polyester resins, e.g., polyethylene terephthalate, and polyamide resins can be used as the other resin that may be combined with the block copolymer.

The forms that the elastic fibers containing the block copolymer can take include (a) single-component fiber made from the block copolymer alone or a polyblend of the block copolymer and other resin(s) and (b) conjugate fiber composed of the block copolymer and other resin(s) in a sheath/core configuration or a side-by-side configuration. Single-component fibers made solely of the block copolymer are preferred.

Regardless of the type of the resin component used to make the elastic fibers, the elastic fibers may be either continuous fibers or staple fibers. Continuous fibers are preferred; for a continuous fiber is continuously drawn by hot air from the nozzle lip, so that the fiber reduces in diameter with reduced variation in diameter. In the case where a continuous fiber is drawn with cool air applied, the same tendencies are observed. As a result, the nonwoven fabric has better formation when seen through and shows reduced variation of stretch characteristics. Capability of producing fibers with a reduced diameter allows for reduction of hot or cool air volume, which contributes to reduction of production cost.

The fibers making up the elastic fiber layer 1 preferably have a fiber diameter of 5 to 100 μm, more preferably 10 to 40 μm from the viewpoint of breathability and ease to stretch.

The elastic fiber layer 1 has capability of extending under tension and, on being released from the tension, retracting or contracting. When the elastic fiber layer 1 is 100% elongated in at least one direction parallel to the plane of the nonwoven fabric and then retracted, the residual strain is preferably 20% or less, more preferably 10% or less. It is desirable that the elastic fiber layer 1 has the recited residual strain in at least one of the MD and CD, particularly preferably in both the MD and CD.

The elastic fiber layer 1 is an aggregate of elastic fibers. The elastic fiber layer 1 may contain inelastic fibers in a proportion preferably of not more than 30%, more preferably of not more than 20%, even more preferably of not more tan 10%, by weight as long as the elasticity of the elastic fiber layer 1 is not impaired. Methods of making elastic fibers include a melt-blowing method in which a molten resin is extruded through orifices and the extruded molten resin is drawn by hot air into fine fibers, a spunbonding method in which a half-molten resin is drawn by cool air or by mechanical drawing, and a blow spinning method, which is a kind of melt spinning method.

The elastic fiber layer 1 may have the form of a web or nonwoven fabric containing elastic fibers obtained by, for example, blow spinning, spunbonding or melt blowing. The elastic fiber layer 1 is particularly preferably a web obtained by blow spinning.

Blow spinning is carried out using a spinning die having a spinning nozzle for extruding a molten polymer, a pair of hot air blowers placed near the tip of the nozzle in a facing relationship symmetrically about the nozzle, and a pair of cool air blowers placed downstream of the hot air blowers in a facing relationship symmetrically about the nozzle. Blow spinning is advantageous in that stretchable fibers are formed easily because molten fibers are drawn successively by hot air and cold air. Blow spinning offers another advantage that highly breathable nonwoven fabric can be obtained because, for one thing, the resulting fibers are not too dense and, for another, stretchable fibers equivalent to the thickness of staple fibers can be formed. Furthermore, blow spinning allows for formation of a web of continuous filaments. A web of continuous filaments is extremely advantageous for use in the present embodiment because it is less liable to break when highly elongated and thus develops elasticity more easily than a staple fiber web.

Figure 2:
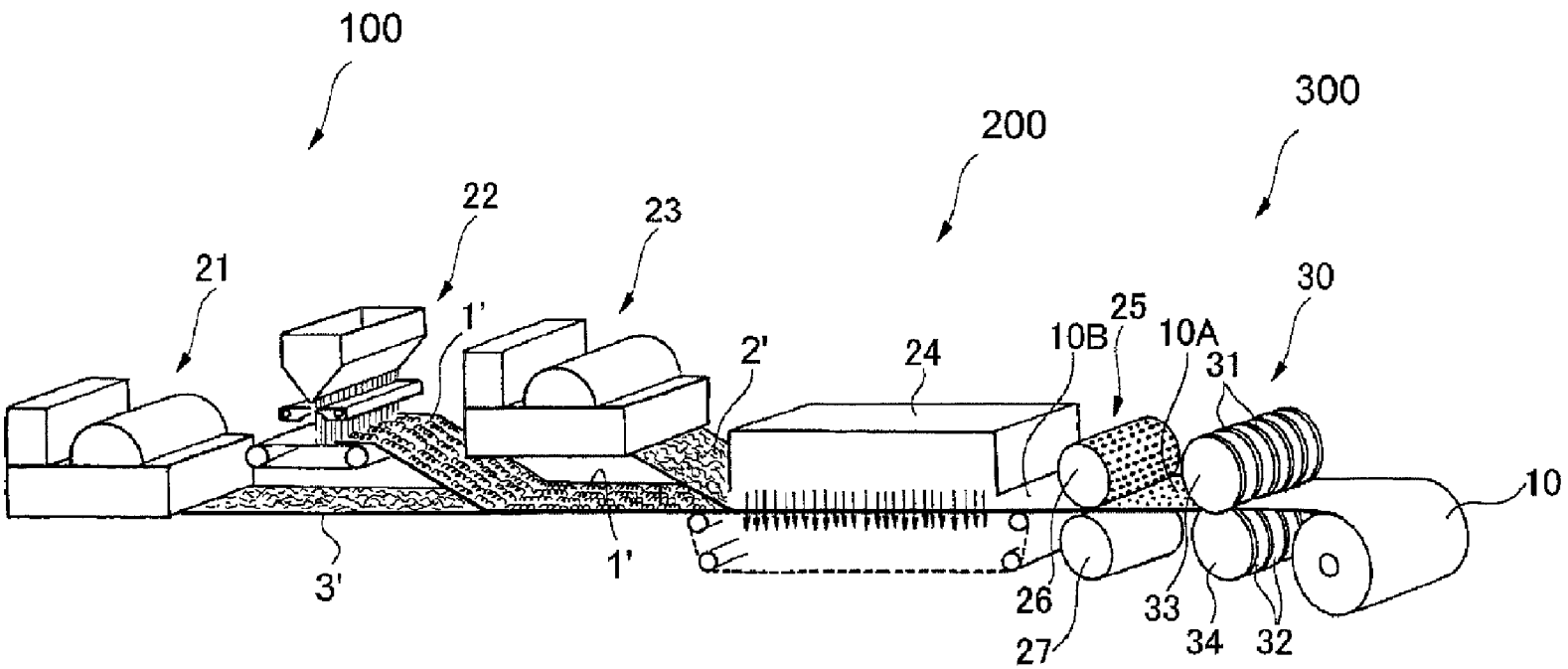
FIG. 2 is a schematic illustration of a preferred form of apparatus that can be used to produce the stretch nonwoven fabric of FIG. 1.

Examples of spinning dies that can be used in blow spinning include the one illustrated in FIG. 1 of JP 43-30017B, the one illustrated in FIG. 2 of U.S. Pat. No. 4,774,125A, and the one illustrated in FIG. 2 of U.S. Pat. No. 5,098,636A. The spinning die illustrated in FIGS. 1 through 3 of US 2001/0026815A1 is also useful. The fibers spun from the spinning die are accumulated on a net conveyor.

The inelastic fiber layers 2 and 3 are extensible but substantially inelastic. The term "extensible" as used herein is intended to include not only a fiber layer whose constituent fibers per se are extensible but also a fiber layer whose constituent fibers are not per se extensible but which shows extensibility as a whole as a result of debonding of constituent fibers that have been thermally bonded at their intersections, structural change of three-dimensional structures formed of a plurality of constituent fibers thermally-bonded to one another, or breaks of the constituent fibers.

The inelastic fiber layers 2 and 3 contain substantially inelastic fibers which are characterized by having a varied thickness along the length thereof. The thus characterized fibers will hereinafter be referred to as varied thickness fibers. The individual varied thickness fiber includes portions with a larger cross-sectional area (or diameter) and portions with a smaller cross-sectional area (or diameter) along its length. The individual varied thickness fiber may have its thickness continuously varied from the finest portions to the thickest portions, or may have its thickness varied stepwise like necking observed in drawing undrawn yarn.

The varied thickness fiber is preferably obtained from a low-drawn, inelastic fiber with a given diameter as a precursor fiber. When the stretch nonwoven fabric of the present embodiment is produced using low-drawn fibers as precursor fibers in accordance with the process described infra, the low-drawn fibers are drawn to create finer portions and converted to varied thickness fibers in the course of the process.

Therefore, the bonds between fibers and the bonds between the inelastic fiber layer and the elastic fiber layer are less destroyed during the process of producing the stretch nonwoven fabric. As a result, it is possible to increase the strength of the stretch nonwoven fabric while retaining the stretch performance properties thereby to provide a stretch nonwoven fabric having both high elongation and high strength. Additionally, the bonds between the varied thickness fibers are hardly destroyed during the process of producing the stretch nonwoven fabric of the present embodiment, the inelastic fiber layer is prevented from assuming a fuzzy appearance. This is advantageous for improving the appearance of the stretch nonwoven fabric of the present embodiment. In contrast, the elastically stretchable composite sheet described in U.S. Pat. No. 6,730,390B1 fails to obtain both high elongation and high strength because the solvent weld or mechanical entanglement between the fibers are undone during the step of stretching, resulting in a reduction of sheet strength.

To start with the low-drawn precursor fibers results in a substantial increase of the number (and length) of fine fibers compared with before drawing (stretching operation), whereby the stretch nonwoven fabric of the present embodiment exhibits improved hiding properties. When used as, for example, a topsheet of an absorbent article such as a sanitary napkin or a disposable diaper, the stretch nonwoven fabric with improved hiding properties is capable of hiding a body fluid absorbed by an absorbent pad from view.

When the varied thickness fiber has its thickness varied periodically, there is produced an additional advantage that the inelastic fiber layer has a crepe texture with a pleasant feel. In this case, the pitch of the thickness changes in terms of a distance from a thickest portion and an adjacent thickest portion is preferably 0.5 to 2.5 mm, more preferably 0.8 to 1.5 mm. The pitch can be measured by microscopic observation of the inelastic fiber layer.

In order to further ensure the above described effects, it is preferred that the varied thickness fiber has a thickness of 2 to 15 μm, more preferably 5 to 12 μm, at the finest portion and of 10 to 30 μm, more preferably 12 to 25 μm, at the thickest portion. The thickness of the varied thickness fiber can be measured by microscopic observation of the inelastic fiber layer.

The precursor fibers providing the varied thickness fibers, i.e., inelastic fibers before a stretching operation, preferably have a higher interfiber thermal bond strength than their strength at 100% elongation so that the thermal bonds between the inelastic fibers may not be destroyed to reduce the strength of the nonwoven fabric when the stretch nonwoven fabric is stretched. The thermal bond strength can be measured by the method taught in commonly assigned US 2006/0063457A1, para. [0041]. The strength at 100% elongation is measured using a tensile tester at an initial jaw spacing of 20 mm and a pulling speed of 20 mm/min.

The varied thickness fibers are, as previously described, preferably obtained from low-drawn, inelastic fibers with a given fiber diameter. The low-drawn fibers may be single-component fibers or conjugate fibers made of two or more materials, such as sheath/core conjugate fibers or side-by-side conjugate fibers. Conjugate fibers are preferred, taking into consideration ease of bonding between the varied thickness fibers and between the inelastic fiber layer and the elastic fiber layer. In using sheath/core conjugate fibers, those having a polyester (e.g., PET or PBT) or polypropylene (PP) core and a low melting polyester (e.g., PET or PBT), PP or polyethylene (PE) sheath are preferred; for they are strongly thermally-bonded to the fibers of the elastic fiber layer containing an olefinic elastomer, thereby preventing delamination.

The varied thickness fibers may be staple fibers or continuous fibers (continuous filaments) and hydrophilic or water repellent. Stable fibers are preferred in the light of the process of producing the stretch nonwoven fabric described later.

The inelastic fiber layers 2 and 3 may be made solely of the varied thickness fibers or contain other inelastic fibers of a constant diameter. Examples of the other inelastic fibers include fibers of PE, PP, PET, PBT, and polyamide. The other inelastic fibers may be staple fibers or continuous fibers and hydrophilic or water repellent.

Sheath/core or side-by-side conjugate fibers, split fibers, modified cross-section fibers, crimped fibers, and heat shrunken fibers and so on are also useful. These fibers may be used either individually or in combination of two or more thereof. In the case where the inelastic fiber layers 2 and 3 contain such other inelastic fibers of a constant diameter in addition to the varied thickness fibers, the amount of the other inelastic is fibers is preferably 1% to 30% by weight, more preferably 5% to 20% by weight, based on the respective layers.

The inelastic fiber layers 2 and 3 may be a web or nonwoven fabric of continuous filaments or staple fibers. A web of staple fibers is preferred for providing thick and bulky inelastic fiber layers 2 and 3. The two inelastic fiber layers 2 and 3 may be either the same or different in material, basis weight, thickness, and the like. The varied thickness fibers may be present in only one of the two inelastic fibers layers 2 and 3.

It is preferred that at least one of the two inelastic fiber layers 2 and 3 has a thickness 1.2 to 20 times, more preferably 1.5 to 5 times, the thickness of the elastic fiber layer 1. It is preferred that the elastic fiber layer 1 has a higher basis weight than at least one of the two inelastic fiber layers 2 and 3. That is, the inelastic fiber layer preferably has a larger thickness and a smaller basis weight than the elastic fiber layer. So related, the inelastic fiber layer is thicker and bulkier than the elastic fiber layer. It follows that the stretch nonwoven fabric 10 has a soft and pleasant hand.

The thickness of each of the inelastic fiber layers 2 and 3 is preferably 0.05 to 5 mm, more preferably 0.1 to 1 mm. The thickness of the elastic fiber layer 1 is preferably smaller than that of the inelastic fiber layers 2 and 3, specifically 0.01 to 2 mm, more preferably 0.1 to 0.5 mm. In measuring the thicknesses, the stretch nonwoven fabric is left to stand with no load applied at 20±2° C. and 65±2% RH for at least 2 days before the measurement. The thus conditioned stretch nonwoven fabric is sandwiched in between two flat plates to apply a load of 0.5 cN/cm$^2$. A cut area of the stretch nonwoven fabric is observed under a microscope at a magnification of 50 to 200 times, and the thickness of each layer is measured to obtain an average of three fields for each layer.

The inelastic fiber layers 2 and 3 each preferably have a basis weight of 1 to 60 g/m$^2$, more preferably 5 to 15 g/m$^2$, in view of uniform coverage over the surface of the elastic fiber layer and residual strain. The elastic fiber layer 1 preferably has a larger basis weight than the inelastic fiber layers 2 and 3, specifically 5 to 80 g/m$^2$, more preferably 10 to 40 g/m$^2$, in view of stretch characteristics and residual strain.

As illustrated in FIG. 1, the elastic fiber layer 1 and the inelastic fiber layer 2 and 3 of the present embodiment are joined all over to each other by thermal bonding at fiber intersections while the fibers constituting the elastic fiber layer 1 remain in the fibrous form. That is, the stretch nonwoven fabric of the present embodiment is different from conventional one in the manner of joining between superposed webs. In the stretch nonwoven fabric 10 of the present embodiment in which the elastic fiber layer 1 is joined all over to the inelastic fiber layers 2 and 3, the fibers making up the elastic fiber layer 1 and the fibers making up each of the inelastic fiber layers 2 and 3 are thermally bonded to each other at their intersections on and near the interfaces between the elastic fiber layer 1 and each of the inelastic fiber layers 2 and 3. Thus, the fiber layers 1, 2, and 3 are joined together substantially all over their interfaces. Being joined all over, the inelastic fiber layers 2 and 3 are each prevented from separating from the elastic fiber layer 1 (delamination) and forming a gap therebetween. If delamination occurs, the elastic fiber layer and the inelastic fiber layers lose integrity, tending to deteriorate the hand of the stretch nonwoven fabric 10. The present invention thus provides stretch nonwoven fabric having a multilayer structure and yet exhibiting integrity like a monolithic nonwoven fabric.

By the expression "the constituent fibers of the elastic fiber layer 1 remain in the fibrous form" or an equivalent expression as used herein is meant that most of the fibers making up the elastic fiber layer 1 are not in a cohesive film-like state or a cohesive film-like/fibrous mixed state even after application of heat, pressure, etc. With the fibers of the elastic fiber layer 1 remaining in a fibrous form, the stretch nonwoven fabric 10 of the present embodiment is assured of sufficient breathability.

The elastic fiber layer 1 has its fibers thermally bonded at their intersections across its thickness. Likewise, both the inelastic fiber layers 2 and 3 have their fibers thermally bonded at their intersections across their thickness.

At least one of the inelastic fiber layers 2 and 3 has part of its constituent fibers enter the elastic fiber layer 1 and/or the elastic fiber layer 1 has part of its constituent fibers enter at least one of the inelastic fiber layers 2 and 3. Such an intermingling state secures the integrity between the elastic fiber layer 1 and the inelastic fiber layers 2 and 3 to effectively prevent delamination. As a result, the layers are interlocked in conformity to their respective surface shapes. Some of the fibers constituting the inelastic fiber layer and entering the elastic fiber layer 1 are confined within the thickness of the elastic fiber layer 1, and some others penetrate through the elastic fiber layer 1 into the opposite inelastic fiber layer. When a macroscopic imaginary plane is drawn to connect fibers existing on the surface of each layer, part of the fibers making up a fiber layer go through the plane and enter the interfiber spaces of the adjoining layer along the thickness of the adjoining layer. It is preferred that the fibers of the inelastic fiber layer which enter and stay within the elastic fiber layer 1 are entangled with the fibers constituting the elastic fiber layer 1. Likewise, it is preferred that the fibers of one of the inelastic fiber layers which penetrate through the elastic fiber layer 1 into the other inelastic fiber layer are entangled with the fibers constituting the other inelastic fiber layer. Such an entangled state of fibers can be confirmed by observing a cross-section of the stretch nonwoven fabric taken across the thickness under an SEM or a microscope to find substantially no spaces left in the interfaces between the fiber layers. As used herein, the term "entangled" means a state of fibers being in sufficient entanglement with each other and does not include a state of fibers of the layers merely stacked on each other. Whether or not fibers are entangled can be judged, for example, in the following manner. Two fiber layers are merely stacked on each other, and a force required to separate them apart is measured. Separately, the same two fiber layers are stacked, a through-air technique is applied without causing thermal bonding, and a force required to separate the stack into the individual layers is measured. When there is a substantial difference between the two forces measured, the fibers of the air-blown layers can be said to be entangled with each other.

In order to cause the fibers of the inelastic fiber layer to enter the elastic fiber layer and/or to cause the fibers of the elastic fiber layer to enter the inelastic fiber layer, it is desirable that at least one of the inelastic fiber layer and the elastic fiber layer is in the form of a web, i.e., a loose aggregate of fibers having no thermal bonds before the step of thermal bonding the fibers of the inelastic fiber layer and the fibers of the elastic fiber layer. To help fibers of a layer to enter another layer, it is desirable that the fiber layer of web form is made up of staple fibers for higher freedom of movement than continuous fibers.

A through-air technique is a preferred process for causing the fibers of the inelastic fiber layer to enter the elastic fiber layer 1 and/or causing the fibers of the elastic fiber layer to enter the inelastic fiber layer. A through-air technique easily causes fibers of a layer to enter another layer facing and in contact therewith and makes the former layer let in fibers of the latter layer. A through-air technique easily causes the fibers of the inelastic fiber layer to enter the elastic fiber layer 1 while retaining the bulkiness of the inelastic fiber layer. A through-air technique is also preferred where the fibers of one of the inelastic fiber layers are to penetrate through the elastic fiber layer 1 into the other inelastic fiber layer. It is particularly preferred that an inelastic fiber layer of web form is superposed on an elastic fiber layer and that the resulting stack be subjected to through-air technique. In this case, the fibers constituting the elastic fiber layer may or may not be thermally bonded to each other. As will be described later with respect to the process of producing the stretch nonwoven fabric, the uniformity of the fibers' entrance into another fiber layer can be increased by controlling the conditions of carrying out the through-air technique and by improving air permeability of the stretch nonwoven fabric, especially the elastic fiber layer, so as to assure easy passage of hot air. Processes other than the through-air technique, e.g., blowing steam, are also useful. Hydroentanglement and needle punching are also employable, but it should be noted that these processes tend to impair the bulkiness of the inelastic fiber layer or to allow the fibers of the elastic fiber layer to emerge on the surface of the nonwoven fabric, which will deteriorate the hand of the stretch nonwoven fabric.

In the cases where the fibers of the inelastic fiber layer are entangled with the fibers of the elastic fiber layer 1, it is preferred that the entanglement is achieved only by a through-air technique.

Fiber entanglement by a through-air technique is preferably accomplished by properly adjusting the air blowing pressure, air velocity, basis weight and thickness of the fiber layers, the running speed of the fiber layers. The fibers of the inelastic fiber layer and those of the elastic fiber layer 1 cannot be entangled with each other simply by adopting the conditions generally employed in the manufacture of air-through nonwovens. As will be described later, stretch nonwoven fabric as aimed at in the invention can first be obtained by carrying out the through-air technique under specific conditions.

A through-air technique is generally performed by blowing air heated to a prescribed temperature through the thickness of a fibrous layer. In such general cases, entanglement of the fibers and thermal bonding at the fiber intersections take place simultaneously. In the present embodiment, however, it is not essential that the fibers are thermally bonded at their intersections in each layer by the through-air technique. In other words, the through-air technique is necessary for causing the fibers of the inelastic fiber layer to enter the elastic fiber layer 1 or for entangling the fibers of the inelastic fiber layer with the fibers of the elastic fiber layer 1 and for thermally-bonding the fibers of the inelastic fiber layer to the fibers of the elastic fiber layer 1. The direction of entrance of the fibers varies depending on the direction of passage of heated gas and the positional relation between the inelastic fiber layer and the elastic fiber layer. It is preferred that the inelastic fiber layer is converted by the through-air technique into air-through nonwoven in which the constituent fibers are thermally bonded at their intersections.

As is apparent from the foregoing description, a preferred form of the stretch nonwoven fabric according to the present invention is substantially inelastic air-through nonwoven fabric having in the inside of its thickness direction an elastic fiber layer 1 the fibers of which maintain a fibrous form, with part of the fibers constituting the air-through nonwoven fabric being in the elastic fiber layer 1 and/or with part of the fibers constituting the elastic fiber layer 1 being in the inelastic fiber layer. In a more preferred form of the stretch nonwoven fabric, part of the fibers constituting the air-through nonwoven fabric are entangled with the fibers constituting the elastic fiber layer 1 only by a through-air technique. Since the elastic fiber layer 1 is confined inside the air-through nonwoven fabric, the fibers of the elastic fiber layer 1 are substantially absent on the surface of the stretch nonwoven fabric. This is favorable in that the stretch nonwoven fabric is free from stickiness inherent to elastic fibers.

The stretch nonwoven fabric 10 of the present embodiment has minute recesses formed on the inelastic fiber layers 2 and 3 as illustrated in FIG. 1. Therefore, the stretch nonwoven fabric 10 has a microscopically waving profile in a cross-sectional view. The waving profile is the result of stretching the stretch nonwoven fabric 10 as will be described with respect to the process of production. The waving profile is the result of imparting stretchability to the stretch nonwoven fabric 10. To have a waving profile does not adversely affect the hand of the nonwoven fabric 10 and is rather beneficial for providing softer and more agreeable nonwoven fabric.

While not illustrated in FIG. 1, the stretch nonwoven fabric 10 of the present embodiment may be an embossed nonwoven fabric. Embossing is for ensuring the bonding strength between the elastic fiber layer 1 and the inelastic fiber layers 2 and 3. Embossing is not essential as long as the elastic fiber layer 1 is sufficiently bonded with the inelastic fiber layers 2 and 2 by a through-air technique. Understandably, embossing causes the constituent fibers to be joined together but, unlike the through-air technique, does not entangle the constituent fibers with each other.

The stretch nonwoven fabric 10 of the present embodiment exhibits stretchability in at least one planar direction. It may have stretchability in every planar direction, in which case the stretchability may vary between different planar directions. In view of obtaining both easy stretch and strength, the stretchability is preferably such that the load at 100% elongation is 20 to 500 cN/25 mm, more preferably 40 to 150 cN/25 mm, in the direction in which the stretch nonwoven fabric 10 is the most stretchable. It is residual strain that is of particular importance with respect to the stretch characteristics of the stretch nonwoven fabric 10 of the present embodiment. According to the present embodiment, the stretch nonwoven fabric 10 can be designed to have a reduced residual strain, as will be demonstrated in Examples given later. Specifically, the residual strain after 100% elongation is preferably 15% or less, more preferably as small as 10% or less.

The stretch nonwoven fabric 10 of the present embodiment is useful in various applications including surgical clothing and cleaning sheets owing to its good hand, resistance to fuzzing, stretchability, and breathability. It is especially suited for use as a material constructing absorbent articles such as sanitary napkins and disposable diapers. For example, it is useful as a sheet defining the exterior surface of a disposable diaper or a sheet for elasticizing a waist portion, a below-waist portion, a leg opening portion, etc. It is also useful as a sheet forming stretchable wings of a sanitary napkin. It is applicable to any other portions designed to be elasticized. The basis weight and thickness of the stretch nonwoven fabric are adjustable as appropriate to the intended use. For example, in application as a material making an absorbent article, the stretch nonwoven fabric is preferably designed to have a basis weight of about 20 to 160 g/m$^2$ and thickness of about 0.1 to 5 mm. Since the fibers of the elastic fiber layer retain the fibrous form, the stretch nonwoven fabric of the present invention is pliable and highly breathable. In this regard, the stretch nonwoven fabric of the invention preferably has a small bending stiffness, a measure of pliability, specifically a bending stiffness of 10 cN/30 mm or smaller, an air permeability of 16 m/(kPa·s) or more. The stretch nonwoven fabric preferably has a maximum strength of 200 cN/25 mm or more in the stretch direction and a maximum elongation percentage of 100% or more in the stretch direction.

The bending stiffness is measured in accordance with JIS L1096 using a handle-o-meter (amount of deflection: 8 mm; slot width: 10 mm). Measurement is taken in the machine direction and cross-machine direction, and an average of the measurements is obtained. The air permeability is obtained as the reciprocal of the air permeation resistance measured with an automatic air-permeability tester KES-F8-AP1 from Kato Tech.

A preferred process for producing the stretch nonwoven fabric 10 of the present embodiment will be described with reference to FIG. 2. FIG. 2 is a schematic illustration of apparatus preferably used to produce the stretch nonwoven fabric 10 of the present embodiment. The apparatus illustrated in FIG. 2 has a web forming section 100, a hot air treatment section 200, and a stretching section 300 in the downstream order.

The web forming section 100 includes a first web forming unit 21, a second web forming unit 22, and a third web forming unit 23. A carding machine is use as the first web forming unit 21 and the third web forming unit 23. Any carding machine generally used in the art can be used with no particular limitation. A blow spinning machine is used as the second web forming unit 22. The blow spinning machine has a spinning die including a spinning nozzle for extruding a molten polymer, a pair of hot air blowers placed near the tip of the nozzle in a facing relationship symmetrically about the nozzle, and a pair of cool air blowers placed downstream of the hot air blowers in a facing relationship symmetrically about the nozzle. Fibers spun through the spinning die are accumulated on a net conveyor.

The hot air treatment section 200 has a hot air oven 24 in which a gas heated to a prescribed temperature, particularly heated air is supplied. Three webs stacked on top of another are introduced into the hot air oven, where a heated gas is forced through the stack in the direction from the upper to lower sides and/or in the direction from the lower to upper sides.

The stretching section 300 has a weakly joining unit 25 and a stretching unit 30. The weakly joining unit 25 has a pair of embossing rollers 26 and 27. The weakly joining unit 25 is to ensure the unity of the webs of a fibrous sheet from the hot air treatment section 200. The stretching unit 30 is installed adjacent to and downstream of the weakly joining unit 25. The stretching unit 30 has a pair of corrugated rollers 33 and 34. The corrugated rollers 33 and 34 each consist of axially alternating large-diameter segments 31 and 32, respectively, and small-diameter segments (not shown) and are adapted to be in a meshing engagement with each other. The fibrous sheet introduced into the nip between the corrugated rollers 33 and 34 is stretched in the axial direction of the rollers (the width direction of the sheet).

The stretch nonwoven fabric is produced by use of the apparatus having the above construction as follows. Webs of the same or different inelastic fibers are superposed on the respective sides of a web of elastic fibers. The web of elastic fibers may contain a small proportion of inelastic fibers in addition to elastic fibers as long as the elastic extensibility of the elastic fiber layer 1 is not impaired.

As illustrated in FIG. 2, in the web forming section 100, inelastic staple fibers are carded in a carding machine (the first web forming unit 21) into an inelastic fiber web 3'. Where necessary, the inelastic fiber web 3' may be temporarily bonded by) for example, through-air technique or passing between heat rollers to cause thermal bonding. The material (precursor fiber) used to make the inelastic fiber web 3' is low-drawn inelastic fibers. The term "low-drawn" as used herein inclusively means "spun and undrawn" and "spun and drawn to a low draw ratio". It is preferred to use low-drawn fibers having an elongation of 80% to 800%, more preferably 120% to 650%. The low-drawn fibers having the preferred elongation are successfully drawn in the stretching unit 30 to become the aforementioned varied thickness fibers easily. The diameter of the low-drawn fibers is preferably 10 to 35 μm, more preferably 12 to 30 μm.

The elongation of the low-drawn fiber is measured in accordance with JIS L1015 under conditions of 20±2° C., 65±2% RH, an initial jaw separation of 20 mm, and a pulling speed of 20 mm/min. In the case when the fiber to be measured is too short (typically when the fiber to be measured is drawn from a prepared nonwoven fabric) to set the initial jaw separation at 20 mm, the jaw separation distance is set to 10 mm or 5 mm.

An elastic fiber web 1' of elastic fibers (continuous filaments) spun through the second web forming unit 22 (blow spinning die) is once accumulated on a net conveyor and then superposed on the inelastic fiber web 3' moving in one direction.

Another inelastic fiber web 2' prepared in the third web forming unit 23 (another carding machine) is superposed on the elastic fiber web 1'. The particulars of the inelastic fiber web 2' are the same as those of the inelastic fiber web 3'. The description of the inelastic fiber web 3' appropriately applies to the inelastic fiber web 2'. The inelastic fiber webs 2' and 3' may be equal or unequal in constituent fibers, basis weight, thickness, and the like.

To make the elastic fiber web 1' by blow spinning is advantageous in that stretchable fibers are formed easily because molten fibers are drawn successively by hot air and cold air. Blow spinning offers another advantage that highly breathable nonwoven fabric can be obtained because, for one thing, the fibers are not too dense and, for another, stretchable fibers equivalent to the thickness of staple fibers can be formed. Furthermore, a web of continuous filaments can be obtained by blow spinning. A web of continuous filaments is extremely advantageous for use in the present embodiment because it is less liable to break when highly elongated and thus develops elasticity more easily than a staple fiber web.

The stack of the three webs is sent to the through-air technique hot air oven 24, where the stack is hot-air treated. By this hot air treatment, the fibers are thermally bonded at their intersections, whereby the elastic fiber web 1' is joined all over to the inelastic fiber webs 2' and 3'. It is preferable that the webs to be hot-air treated are non-united to one another in the stack in order to maintain each web in a thick and bulky state even after the hot air treatment and to provide stretch nonwoven fabric with a pleasant hand.

When the fibers are thermally bonded at their intersections by the hot air treatment thereby to unite the three webs all over, it is preferred to cause part of the fibers making up the inelastic fiber webs, mainly of those constituting the web 2' on the side to which hot air is blown, to enter the elastic fiber web 1'. By controlling the conditions of the hot air treatment, it is preferred to cause part of the fibers making up the inelastic fiber web 2' to enter the elastic fiber web 1' and to be entangled with the fibers of the web 1', or it is preferred to cause part of the fibers of the inelastic fiber web 2' to penetrate through the elastic fiber web 1' into the inelastic fiber web 3' and to be entangled with the fibers of the web 3'.

In order to cause part of the fibers of the inelastic fiber web 2' to enter the elastic fiber web 1' and/or to cause part of the fibers of the elastic fiber web 1' to enter the inelastic fiber web 2', the hot air treatment is preferably carried out at a hot air velocity of 0.4 to 3 m/s, a temperature of 80° C. to 160° C., and a running speed of 5 to 200 m/min for a treating time of 0.5 to 10 seconds. The hot air velocity is more preferably 1 to 2 m/s. To use a highly air-permeable net in the through-air technique helps the fibers to enter. In the case where the elastic fiber web 1' is directly spun on the inelastic fiber web 3', the air blown in the spinning region similarly helps the fibers of the elastic fiber web 1' to enter the inelastic fiber web 3'. The nets that can be used in the hot air treatment and the direct spinning of the elastic fibers preferably have an air permeability of 250 to 800 $cm^3/(cm^2 \cdot s)$, more preferably 400 to 750 $cm^3/(cm^2 \cdot s)$. The above-recited conditions are also preferred in order to soften the fibers for facilitating uniform fiber entrance and thermal bonding. Having the fibers entangled can be achieved by applying hot air at a velocity of 3 to 5 m/s under a pressure of 0.1 to 0.3 kPa. The elastic fiber web 1' preferably has an air permeability of 8 m/(kPa·s) or more, more preferably 24 m/(kPa·s) or more. The recited air permeability secures effective flow of hot air through the web 1' thereby to allow the fibers to enter uniformly and to facilitate thermal bonding of the fibers thereby increasing the maximum strength and preventing fuzzing.

In the hot air treatment, it is desirable that the entrance of part of the fibers of the inelastic fiber web 2' into the elastic fiber web 1' takes place simultaneously with the thermal bonding of the fibers of the inelastic fiber web 2' and/or the fibers of the inelastic fiber web 3' to the fibers of the elastic fiber web 1' at their intersections. In this case, the hot air treatment is preferably performed under such conditions as to allow the elastic fibers to remain in a fibrous form after the hot air treatment. That is, it is preferred that the hot air treatment conditions are not such that change the fibers constituting the elastic fiber web 1' into a film-like structure or a film-like/fibrous mixed structure. In the hot air treatment, the fibers in each of the inelastic fiber web 2', the elastic fiber web 1', and the inelastic, fiber web 3' are thermally bonded among themselves at their intersections.

As a result of the hot air treatment in a through-air technique, a fibrous sheet 10B having the three webs united is obtained. The fibrous sheet 10B has a continuous length running in one direction with a given width. The fibrous sheet 10B is then forwarded to the stretching section 300. In the stretching section 300, the fibrous sheet 10B is first passed through the weakly joining unit 25, which is an embossing machine including a metallic embossing roller 26 having embossing projections regularly arranged on its peripheral surface and a metallic or resin back-up roller 27 facing to the embossing roller 26. The fibrous sheet 10B is heat embossed while passing through the weakly joining unit 25 to become an embossed fibrous sheet 10A. Since the webs introduced into the stretching section 300 have previously been united by the thermal bonding in the preceding hot air treatment section 200, the heat embossing by the weakly joining unit 25 is not essential in the present invention. The heat embossing by the weakly joining unit 25 is effective where it is demanded to ensure the integrity of the webs. Processing by the weakly joining unit 25 produces an additional advantage that the fibrous sheet 10A is made more resistant to fuzzing.

Since the heat embossing by the weakly joining unit 25 is auxiliary to the thermal bonding that has been done in the hot air treatment section 200, the embossing conditions are relatively mild. Severe embossing conditions would impair the bulkiness of the fibrous sheet 10A and could cause the fibers to become cohesive film-like. This adversely affect the hand and breathability of the resulting stretch nonwoven fabric. Accordingly, the linear pressure applied in the heat embossing and the temperature of the embossing roller should be decided with these factors taken into consideration.

Figure 3:
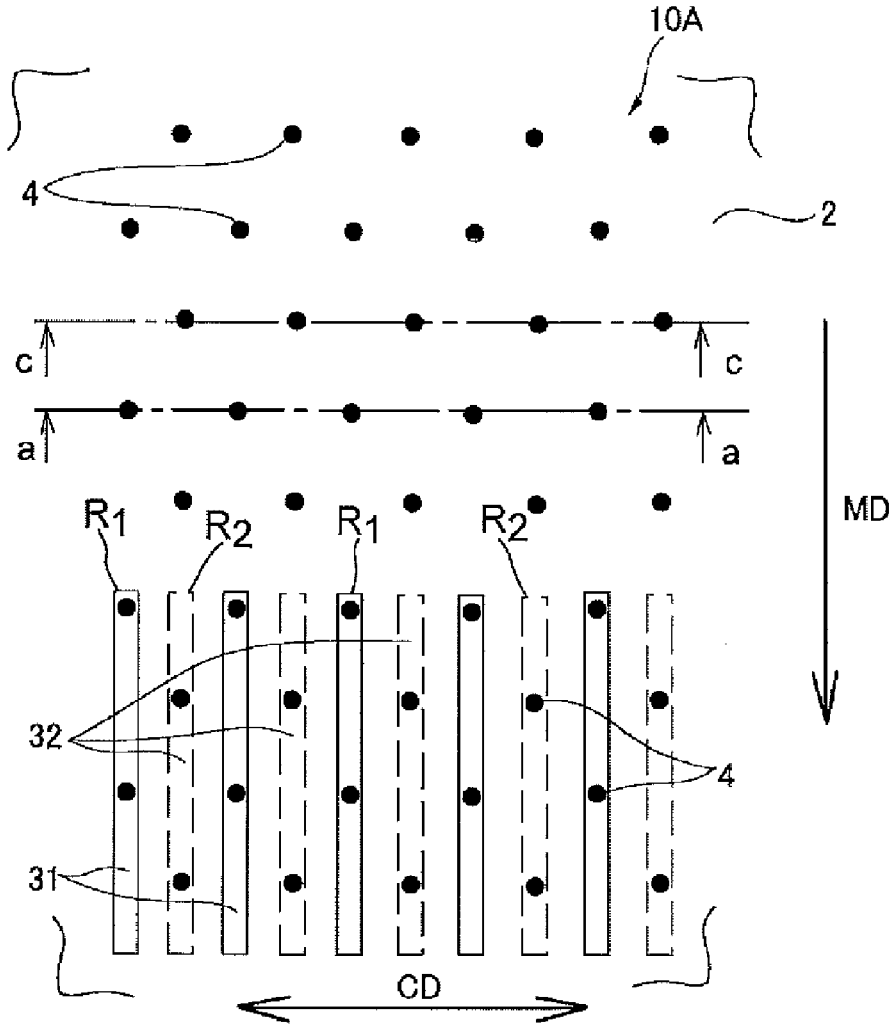
FIG. 3 is a plan of an example of a fibrous sheet that is to be stretched.

The heat-embossed fibrous sheet 10A has a number of discrete bonds 4 as illustrated in FIG. 3. The bonds 4 are arranged in a regular pattern. The bonds 4 are preferably arranged discretely in, for example, both the machine direction (MD) and the cross machine direction (CD).

Figure 4:
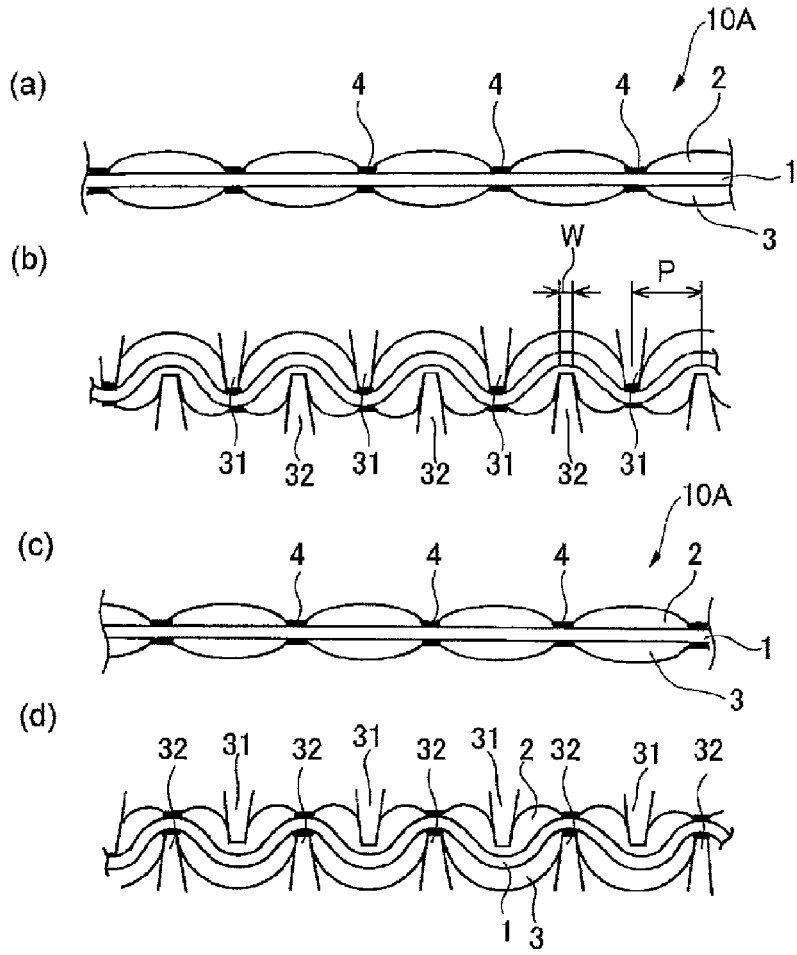
FIG. 4(*a*) is a cross-section of the fibrous sheet of FIG. 3, taken along line a-a parallel to the CD, FIG. 4(*b*) is a cross-section corresponding to FIG. 4(*a*), in which the fibrous sheet is being deformed (being stretched) between corrugated rollers, FIG. 4(*c*) is a cross-section of the fibrous sheet of FIG. 3, taken along line c-c parallel to the CD and FIG. 4(*d*) is a cross-section corresponding to FIG. 4(*c*), in which the fibrous sheet is being deformed (being stretched) between corrugated rollers.

The fibrous sheet 10A from the weakly joining unit 25 is then sent to the stretching unit 30. As illustrated in FIGS. 2 to 4, the fibrous sheet 10A is introduced into the nip between the corrugated rollers 33 and 34 each consisting of axially alternating large-diameter segments 31 and 32, respectively, and small-diameter segments (not shown). The fibrous sheet 10A is thus stretched in the CD perpendicular to the machine direction (MD).

The stretching unit 30 has a known vertical displacement mechanism (not shown) for vertically displacing the axis of either one of or both of the corrugated rollers 33 and 34 to adjust the clearance between the rollers 33 and 34. As illustrated in FIGS. 1, 4(*b*), and 4(*d*), the corrugated rollers 33 and 34 are configured such that the large-diameter segments 31 of the corrugated roller 33 fit with clearance into the recesses between every adjacent large-diameter segments 32 of the other corrugated roller 34 and that the large-diameter segments 32 of the other corrugated roller 34 fit with clearance into the recesses between every adjacent large-diameter segments 31 of the corrugated roller 33. The fibrous sheet 10A is introduced into the nip between the so configured rollers 33 and 34 to be stretched.

In the stretching step, it is preferred that the lateral positions of the bonds 4 in the fibrous sheet 10A are coincident with those of the large-diameter segments 31 and 32 of the respective corrugated rollers 33 and 34 as illustrated in FIGS. 3 and 4. Specifically, as illustrated in FIG. 3, the fibrous sheet 10A has straight lines of bonds (hereinafter "bond lines" (10 bond lines in FIG. 3)) parallel to the MD, each line having the bonds 4 spacedly aligned in the MD. The positions of the large-diameter segments 31 of the corrugated roller 33 are coincident with the positions of the bonds 4 in every other bond line starting from the leftmost bond line in FIG. 3, designated $R_1$. The positions of the large-diameter segments 32 of the other corrugated roller 34 are coincident with the positions of the bonds 4 in every other bond line starting from the second leftmost bond line, designated $R_2$. The regions indicated by numerals 31 and 32 in FIG. 3 are the regions of the fibrous sheet 10A that are to come into contact with the top face of the large-diameter segments 31 and 32 of the respective rollers at a point of time while the sheet 10A is passing between the corrugated rollers 33 and 34.

Figure 5:
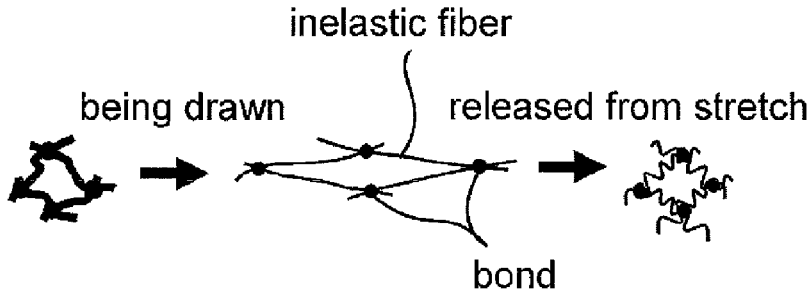
FIG. 5 is a schematic showing inelastic fibers being drawn.

During the passage of the fibrous sheet 10A through the nip between the corrugated rollers 33 and 34, the bonds 4 come into contact with the large-diameter segments (31 or 32) of either one of the rollers 33 and 34, while the regions of the fibrous sheet 10A between the large-diameter segments (the regions that do not come into contact with the large-diameter segments) are positively stretched as illustrated in FIGS. 4(*b*) and 4(*d*). In particular, the low-drawn fibers contained in the inelastic fiber layers 2 and 3 are drawn and made finer between the bonds 4 into varied thickness fibers. That is, the stretching force by the corrugated rollers 33 and 34 serves chiefly to draw the low-drawn fibers, with no excessive force imposed to the bonds 4. As a result, the regions of the fibrous sheet 10A other than the bonds can be stretched efficiently without being accompanied by breaks or delamination at the bonds 4. As illustrated in FIG. 5, this stretching operation extends the inelastic fiber layers 2 and 3 sufficiently without destroying the interfiber bonds, whereby the interference by the inelastic fiber layers 2 and 3 with the free expansion and contraction of the elastic fiber layer 1 is greatly lessened. Thus, the process described accomplishes efficient production of a stretch nonwoven fabric exhibiting high strength and stretchability and a good appearance with little break or fuzzing. Note that the inelastic fibers are depicted as having uniform thickness in FIG. 5 for the sake of convenience.

As described, the process of the invention successfully achieves drawing or extension of the inelastic fibers without causing destruction of the bonds between the inelastic fibers, so that reduction in sheet strength due to the stretching operation can be minimized. Specifically, the ratio of the tensile strength of a fibrous sheet A after the stretching operation (i.e., a desired stretch nonwoven fabric) to the tensile strength of a fibrous sheet A before the stretching operation (i.e., a precursor of a desired stretch nonwoven fabric) is preferably 0.3 to 0.99, more preferably 0.5 to 0.99, even more preferably 0.7 to 0.99, approaching to 1. The term "tensile strength" as used herein denotes a strength measured in accordance with the method of measuring maximum strength that will be described in Examples hereinafter given.

By the above described stretching operation, the thickness of the fibrous sheet 10A preferably increases to 1.1 to 4 times, more preferably 1.3 to 3 times, the thickness before the stretching operation. The fibers of the inelastic fiber layers 2 and 3 extend and become finer as a result of plastic deformation. At the same time, the inelastic fiber layers 2 and 3 become bulkier to provide a better feel to the touch and better cushioning.

For the fibrous sheet 10A before being stretched to have a smaller thickness is beneficial for saving the space for transportation and storage of the stock roll.

It is preferred that the stretching step is such that the bending stiffness of the fibrous sheet 10A is reduced to 30% to 80%, more preferably 40% to 70%, of the bending stiffness before the stretching operation thereby to provide soft and drapable nonwoven fabric. It is preferred for the fibrous sheet 10A before being stretched to have a high bending stiffness so that the fibrous sheet 10A may be prevented from wrinkling during transfer and stretching operation.

The thickness and bending stiffness of the fibrous sheet 10A before and after the stretching operation can be controlled by the elongation of the fibers used to make the inelastic fiber layers 2 and 3, the embossing pattern of the embossing roller, the pitch and top face width of the large-diameter segments of the corrugated rollers 33 and 34, and the depth of engagement between the corrugated rollers 33 and 34.

The thickness of the stretch nonwoven fabric was measured after it was conditioned in an environment of 20±2° C. and 65±2% RH for at least 2 days with no load applied. The so conditioned stretch nonwoven fabric was sandwiched in between a pair of plates to apply a load of 0.5 cN/cm$^2$ to the nonwoven fabric, and a cut area of the nonwoven fabric under load was observed under a microscope at a magnification of 25 to 200 times to obtain the average thickness of each fiber layer. The distance between the plates was measured to give the overall thickness of the nonwoven fabric. When the fibers mutually enter the adjoining fiber layers, the midpoint of the intermingling zone was taken as the interface of the layers.

The top face of the large-diameter segments 31 and 32 of the respective corrugated rollers 33 and 34 is preferably not sharply pointed so as not to damage the fibrous sheet 10A. It is preferably a flat face having a certain width as illustrated in FIGS. 4(*b*) and 4(*d*). The top face width W of the large-diameter segments (see FIG. 154(*b*)) is preferably 0.3 to 1 mm and is preferably 0.7 to 2 times, more preferably 0.9 to 1.3 times, the size of the bonds 4 in the CD. With that configuration, the fibrous form of the inelastic fibers is prevented from being destroyed, and a high strength, stretch nonwoven fabric can be obtained.

The pitch P of the mutually facing large-diameter segments (see FIG. 4(*b*)) is preferably 0.7 to 2.5 mm. The pitch P is preferably 1.2 to 5 times, more preferably 2 to 3 times, the size of the bonds 4 in the CD. With that configuration, a cloth-like appearance and a good feel to the touch can be obtained. Although the pitch of the bonds 4 in the CD (the distance between adjacent bond lines $R_1$) is basically double the pitch P of the mutually facing large-diameter segments for positional coincidence, positional coincidence will be obtained as long as the former pitch falls within the range of from 1.6 to 2.4 times the latter pitch taking into consideration the elongation and neck-in of the fibrous sheet 10A in the CD.

The low-drawn fibers contained in the inelastic fiber layers 2 and 3 are drawn and made finer into varied thickness fibers while passing through the meshing engagement between the corrugated rollers 33 and 34 as previously stated. The meshing engagement is taken advantage of in making varied thickness fibers with their thickness varied periodically. In detail, the low-drawn fibers are extended between every adjacent large-diameter segments. The extension of the low-drawn fibers varies according to the pitch P of the large-diameter segments. Accordingly, the interval of the thickness changes of the varied thickness fibers can be controlled by adjusting the pitch P.

On coming out of the stretching unit 30, the fibrous sheet 10A is released from the laterally stretched state, that is, the extension is relaxed. As a result, extensibility and retractibility or contractibility develop in the fibrous sheet 10A, and the sheet 10A retracts in its width direction, whereupon the inelastic fibers blouse between their joints as illustrated in FIG. 5. In that way, a desired stretch nonwoven fabric 10 is obtained. When the fibrous sheet 10A is released from the stretched state, it may be released from the stretched state either completely or in a manner that the stretched state remains to some extent as long as extensibility and retractibility develop.

Another preferred embodiment of the present invention is then described. The description on the foregoing embodiment applies to the embodiment described hereunder unless otherwise specified.

While in the embodiment described supra the varied thickness fibers are present in the inelastic fiber layer, the stretch nonwoven fabric of the present embodiment contains inelastic, varied thickness fibers in its elastic fiber layer. The stretch nonwoven fabric of the present embodiment may have a single layer structure formed of an elastic fiber layer containing elastic fibers and inelastic, varied thickness fibers or a multilayer structure composed of an elastic fiber layer containing elastic fibers and inelastic, varied thickness fibers and an inelastic fiber layer disposed on at least one side of the elastic fiber layer.

In the case where the stretch nonwoven fabric of the present embodiment has a single layer structure, the nonwoven fabric contains elastic fibers and inelastic, varied thickness fibers and may further contain inelastic fibers with a constant thickness. In the case where the stretch nonwoven fabric of the present embodiment has a multilayer structure, the inelastic fiber layer may or may not contain varied thickness fibers.

Irrespective of whether the stretch nonwoven fabric of the present embodiment has a single layer structure or a multilayer structure, the weight ratio of the elastic fibers to the inelastic fibers in the elastic fiber layer is preferably 20/80 to 80/20, more preferably 30/70 to 70/30, to develop good stretch characteristics and high strength, a pleasant feel, and an improved hand. The term "inelastic fibers" as used here is intended to include both inelastic, varied thickness fibers and inelastic fibers with a constant thickness.

Figure 6:
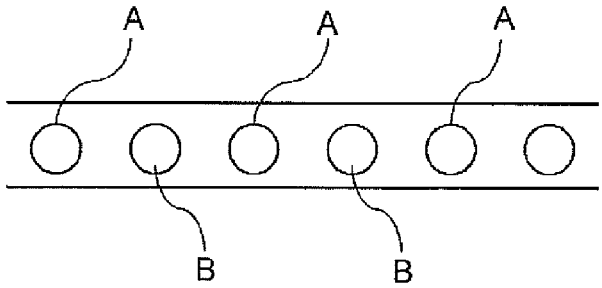
FIG. 6 is a schematic view of an example of a spinning die structure.

The stretch nonwoven fabric of the present embodiment can be produced in the same manner as for the stretch nonwoven fabric of the foregoing embodiment. Specifically, a web containing elastic fibers and low-drawn inelastic fibers having an elongation of 80% to 800% is formed. Such a web can be formed by, for example, blow spinning as previously discussed. A spinning die that can be used in blow spinning to make the web is illustrated in FIG. 6. The spinning die of FIG. 6 has spinning nozzles A and B arranged alternately. A resin making elastic fibers is extruded from the nozzles A, while a resin making inelastic fibers is extruded from the nozzles B.

In the case of making a single layered stretch nonwoven fabric, the resulting web is subjected to a through-air technique to thermal bond the fibers at their intersections to obtain a fibrous sheet. In the case of making a multilayered stretch nonwoven fabric, a separately prepared inelastic fiber web is superposed on at least one side of the resulting web, followed by through-air technique to obtain a fibrous sheet.

The resulting fibrous sheet is stretched in at least one direction to draw the low-drawn inelastic fibers and then released from the stretch to obtain a desired stretch nonwoven fabric.

The present invention is not limited to the embodiments described supra. For example, while the stretch nonwoven fabric 10 of the foregoing embodiment consists of three layers, i.e., the elastic fiber layer 1 and two inelastic fibers layers 2 and 3, which are substantially inelastic and may be the same or different, disposed on the respective sides of the elastic fiber layer 1, the stretch nonwoven fabric of the invention may have a dual layer structure consisting of an elastic fiber layer and an inelastic fiber layer disposed on one side of the elastic fiber layer. In applying the dual layered stretch nonwoven fabric as a material constructing an absorbent article, particularly when used in a site that is to come into contact with the wearer's skin, the stretch nonwoven fabric is preferably used with its inelastic fiber layer side being to face the wearer's skin to give a wearer a good feel and a stickiness-free comfort and so on.

While, in the process illustrated in FIG. 4, the fibrous sheet 10A is stretched without being nipped between the large-diameter segments of one of the corrugated rollers and the small-diameter segments of the other corrugated roller, the clearance between the two corrugated rollers may be decreased so that the fibrous sheet 10A may be stretched as nipped between them. In other words, the large-diameter segments of one corrugated roller may be perfectly mated with the small-diameter segments of the other corrugated roller via the fibrous sheet. The stretching step may be carried out by the method described in JP 6-133998A.

While in the process described supra the fibrous sheet 10A is stretched in the CD, the fibrous sheet may be stretched in the MD or both the CD and MD.

While in the foregoing embodiment, the inelastic fiber layer has part of its fibers enter the elastic fiber layer and/or the elastic fiber layer has part of its fibers enter the inelastic fiber layer, the structure of the stretch nonwoven fabric of the invention is not limited thereto.

EXAMPLES

The present invention will now be illustrated in greater detail with reference to Examples, but it should be understood that the invention is not limited thereto.

Example 1

A stretch nonwoven fabric shown in FIG. 1 was produced by the use of the apparatus illustrated in FIG. 2. Conjugate staple fibers (sheath: PE; core: PET) having a diameter of 17 μm, a length of 44 mm, and an elongation of 150% were fed to the carding machine to form a carded web as an inelastic fiber web 3'. The inelastic fiber web 3' had a basis weight of 10 g/m$^2$. An elastic fiber web 1' described below was superposed on the inelastic fiber web 3'.

The elastic fiber web 1' was formed as follows. An SEBS resin having a weight average molecular weight of 50,000, an MFR of 15 (230° C., 2.16 kg), a storage modulus G' of $2\times10^6$ Pa, and a tan δ of 0.06 was used as an elastic resin. The SEBS block copolymer consisted of 20 wt % styrene as a polymer block A and 80 wt % ethylene-butylene as a polymer block B. The resin was melted in an extruder and extruded through a spinning nozzle at a die temperature of 310° C. and blown by a blow spinning process to form an elastic fiber web 1' on a net. The elastic fiber had a diameter of 32 μm. The web 1' had a basis weight of 40 g/m$^2$.

An inelastic fiber web 2' made of the same inelastic staple fibers as the web 3' and having a basis weight of 10 g/m$^2$ was superposed on the elastic fiber web 1'.

The stack of the three webs was introduced into the heat treatment unit, where a hot air was blown to the stack in a through-air technique. The hot air treatment was carried out at a temperature (on the net) of 140° C., a hot air velocity of 2 M/s, and a blowing pressure of 0.1 kg/cm$^2$ for a treating time of 15 seconds. By the heat treatment a fibrous sheet 10B consisting of the three webs joined together was obtained.

The fibrous sheet 10B was then heat embossed using an embosser having an embossing roller and a flat metal roller. The embossing roller had a number of raised dots at a pitch of 2.0 mm in the CD (the distance between adjacent bond lines $R_1$). The rollers were both set at 110° C. As a result of the heat embossing, a fibrous sheet 10A having bonds in a regular pattern was obtained.

The fibrous sheet 10A was subjected to stretching in the stretching unit is composed of an engaged pair of corrugated rollers each having axially alternating large-diameter segments and small-diameter segments. The pitch of the large-diameter segments and that of the small-diameter segments on the same corrugated roller were both 2.0 mm. The fibrous sheet 10A was stretched in the CD by the stretching operation. As a result, nonwoven fabric with a basis weight of 60 g/m$^2$ and having stretchability in the CD was obtained. The transfer rate of the sheeting was 10 m/min in each of the above operations.

Examples 2 to 4

A stretch nonwoven fabric 10 shown in FIG. 1 was produced as follows. Low-drawn, inelastic, conjugate staple fibers (sheath: PE; core: PET) having a length of 44 mm and the diameter and elongation shown in Table 1 below were fed to a carding machine to form a carded web. The carded web was introduced into a heat treatment unit, where hot air was blown to the web in a through-air technique to temporarily thermal bond the fibers. The heat treatment was carried out at a temperature (on the net) of 137° C. The heat treatment provided an inelastic fiber web 3' having the fibers temporarily fusion bonded to one another and having a basis weight of 10 g/m$^2$. An elastic fiber web 1' made of continuous filaments was superposed directly on the inelastic fiber web 3'.

The elastic fiber web 1' was prepared in the same manner as in Example 1. The elastic fiber had a diameter of 32 μm, and the web 1' had a basis weight of 40 g/m$^2$.

An inelastic fiber web 2' made of the same inelastic staple fibers as described above and having a basis weight of 10 g/m$^2$ was superposed on the elastic fiber web 1'. The fibers of the web 2' were not temporarily thermally bonded.

The stack of the three webs was introduced into a heat treatment unit, where a hot air was blown to the stack in a through-air technique. The hot air treatment was carried at a temperature (on the net) of 140° C., a hot air velocity of 2 m/s, and a blowing pressure of 0.1 kPa for a treating time of 15 seconds. The net had an air permeability of 500 cm$^3$/(cm$^2$·s). The heat treatment provided a fibrous sheet 10B consisting of the three webs joined together.

The fibrous sheet 10B was then heat embossed using an embosser having an embossing roller and a flat metal roller. The embossing roller had a large number of raised dots at a pitch of 2.0 mm in both the CD and MD. The rollers were both set at 120° C. The heat embossing provided a fibrous sheet 10A having bonds in a regular pattern, which was taken up into a roll.

The fibrous sheet 10A was unrolled and subjected to stretching using a stretching unit composed of an engaged pair of toothed rollers having teeth and bottom lands which extend along the axial direction and alternate along the rotating direction. The pitch of the teeth and that of the bottom lands on the same toothed roller were both 2.0 mm (the pitch of the teeth of the two toothed rollers in meshing engagement was 1.0 mm). The depth of engagement of the toothed rollers was adjusted so as to stretch the fiber sheet 10A 3.0 times in the MD. As a result, nonwoven fabric 10 weighing 60 g/m$^2$ and having stretchability in the MD was obtained.

Example 5

A stretch nonwoven fabric 10 shown in FIG. 1 was produced. An elastic fiber web 1' was formed as follows. An elastomeric SEPS (styrene-ethylene-propylene-styrene) block copolymer resin having a weight average molecular weight of 50,000, an MFR of 60 g/min (230° C., 2.16 kg), a storage modulus G' of $5\times10^5$ Pa, and a tan δ of 0.045 was used as an elastomer resin. The SEPS block copolymer consisted of 30 wt % styrene as a polymer block A and 70 wt % ethylene-propylene as a polymer block B. The resin was melted in an extruder and extruded through a spinning nozzle at a die temperature of 290° C. and blown by a blow is spinning process to form an elastic fiber web 1' of continuous filaments on a net. The elastic fiber had a diameter of 20 μm. The elastic fiber web 1' had good formation. The web 1' had a basis weight of 15 g/m$^2$. In otherwise the same manner as in Example 2, a stretch nonwoven fabric 10 having a basis weight of 35 g/m$^2$ and MD stretchability was obtained.

Comparative Example 1

A stretch nonwoven fabric was prepared in the same manner as in Example 1, except that the inelastic fiber web was formed of inelastic staple fibers having an elongation of 40% in place of the low-drawn inelastic staple fibers.

Comparative Example 2

A stretch nonwoven fabric was obtained in the same manner as Comparative Example 1 with the exception that a styrene-vinylisoprene block copolymer HYBRAR® 7311 from Kuraray Co., Ltd. was used as a block copolymer. The block copolymer consisted of 12 wt % styrene and 88 wt % vinylisoprene and had a storage modulus G' of $1.0\times10^6$ and a tan δ of 0.3.

Comparative Example 3

A stretch nonwoven fabric was obtained in the same manner as Comparative Example 1 with the exception that a styrene-ethylene-butylene-styrene block copolymer TUFTEC® H1031 from Asahi Kasci Chemicals was used as a block copolymer. The block copolymer consisted of 30 wt % styrene and 70 wt % ethylene-butylene and had a storage modulus G' of $1.0\times10^7$ and a tan δ of 0.03.

Evaluation

The characteristics of the stretch nonwoven fabrics obtained in Examples and Comparative Examples are shown in Table 1. The measurements and evaluations were made in accordance with the following methods.

(1) Largest and Smallest Diameters of Inelastic Fiber

The surface (5 mm×5 mm) of the stretch nonwoven fabric was observed under a scanning electron microscope (SEM). An average of the diameters at five thick portions and an average of the diameters at five fine portions were obtained as the largest and smallest diameters, respectively.

(2) Fusion Bond Strength, Strength at 100% Elongation, and Elongation of Inelastic Fiber Before Being Stretched (Precursor Fibers)

These characteristics were measured in accordance with the methods previously described.

(3) Thickness

The thickness of the stretch nonwoven fabric was measured after it was conditioned in an environment of 23±2° C. and 60% RH for at least 2 days with no load applied. The so conditioned stretch nonwoven fabric was sandwiched in between a pair of plates to apply a load of 0.5 cN/cm$^2$ to the nonwoven fabric, and a cut area of the nonwoven fabric under load was observed under a microscope at a magnification of 25 to 200 times to obtain the average thickness of each fiber layer. The distance between the plates was measured to give the overall thickness of the nonwoven fabric. When the fibers mutually enter the adjoining fiber layers, the midpoint of the intermingling zone was taken as the interface of the layers.

(4) Bending Stiffness

Bending stiffness was measured in accordance with the method described supra using a handle-o-meter HOM-3 from Daiei Kagaku Seiki Co., Ltd.

(5) Maximum Strength, Maximum Elongation, Strength at 100% Elongation, Strength at 50% Retraction, and Residual Strain A test specimen measuring 50 mm long along the stretchable direction and 25 mm wide along the direction perpendicular to the stretchable direction was cut out of a stretch nonwoven fabric. The specimen was set in Tensilon RTC1210A from Orientec Co., Ltd. with an initial jaw separation of 25 mm. The specimen was elongated in the stretchable direction at a rate of 300 mm/min while recording the load. The maximum load needed was taken as a maximum strength. Taking the initial length of the specimen and the length of the specimen under the maximum load as A and B, respectively, the maximum elongation percentage was calculated from $\{(B-A)/A\}\times100$. Further, the test specimen was subjected to a 100% elongation cycle test to obtain strength at 100% elongation from the load at 100% elongation. After 100% elongation, the elongated specimen was retracted to 50% elongation at the same speed, and the load at the 50% elongation was recorded as a strength at 50% retraction. After 100% elongation followed by retraction at the same speed to the initial length, the ratio of the residual elongation (the length that the specimen failed to be retracted) to the initial length was taken as a residual strain. The maximum strength of the fibrous sheet A, a precursor of the stretch nonwoven fabric, was measured in the same manner as described above.

(6) Feel to the Touch

Three test persons touched the surface of the stretch nonwoven fabric with the palm of their hand and rated the feel as A (smooth with no resistance (roughness)), B (slightly smooth with no resistance), C (slightly resistant), or D (resistant). When two or three test persons gave a sample the same grade, that grade was adopted. When the three test persons gave a sample different grades, the intermediate grade was adopted.

TABLE 1

| | | | Example 1 | Example 2 | Example 3 | Example 4 | Example 5 | Comp. Example 1 | Comp. Example 2 | Comp. Example 3 |
|---|---|---|---|---|---|---|---|---|---|---|
| Precursor Fiber of Inelastic Fiber | Diameter (μm) | | 17 | 18 | 19 | 22 | 19 | 17 | 17 | 17 |
| | Fusion Bond Strength (mN/tex) | | 30 | 30 | 30 | 29 | 30 | 28 | 28 | 28 |
| | Strength at 100% Elongation (mN/tex) | | 22 | 20 | 19 | 17 | 19 | break | break | break |
| | Elongation (%) | | 150 | 200 | 270 | 430 | 270 | 40 | 40 | 40 |
| Nonwoven Fabric before/after Stretching | Thickness (mm) | before stretching | 0.62 | 0.62 | 0.62 | 0.62 | 0.62 | 0.66 | 0.65 | 0.69 |
| | | after stretching | 0.75 | 0.8 | 0.8 | 0.8 | 0.8 | 0.7 | 0.75 | 0.8 |
| | Bending Stiffness (cN/30 mm) | before stretching | 1.9 | 2.0 | 2.0 | 2.0 | 2.0 | 2.8 | 2.4 | 2.4 |
| | | after stretching | 1.5 | 1.5 | 1.5 | 1.5 | 1.5 | 1.6 | 1.6 | 1.8 |
| | Maximum Strength (cN/25 mm) | before stretching | 300 | 1080 | 990 | 670 | 1020 | 400 | 380 | 370 |
| | | after stretching | 280 | 300 | 700 | 540 | 720 | 170 | 200 | 190 |

TABLE 1-continued

| | | Example 1 | Example 2 | Example 3 | Example 4 | Example 5 | Comp. Example 1 | Comp. Example 2 | Comp. Example 3 |
|---|---|---|---|---|---|---|---|---|---|
| Stretch Nonwoven Fabric (after Stretching) | Largest Diameter of Inelastic Fiber (μm) | 17 | 18 | 19 | 22 | 19 | 17 | 17 | 17 |
| | Smallest Diameter of Inelastic Fiber (μm) | 10 | 10 | 10 | 10 | 11 | 17 | 17 | 17 |
| | Maximum Elongation (%) | 220 | 170 | 170 | 180 | 170 | 230 | 200 | 200 |
| | Strength at 100% Elongation (cN/25 mm) | 45 | 55 | 55 | 55 | 68 | 45 | 85 | 150 |
| | Strength at 50% Retraction (cN/25 mm) | 17 | 19 | 19 | 19 | 25 | 17 | 8 | 10 |
| | Residual Strain (%) | 10 | 10 | 10 | 10 | 8 | 10 | 20 | 18 |
| | Feel to the Touch | A | A | A | A | A | B | B | B |
| | Stretch (Measuring) Direction | CD | MD | MD | MD | MD | CD | CD | CD |

As is apparent from the results in Table 1, the nonwoven fabrics of Examples exhibit higher strength and elongation than those of Comparative Examples while retaining as good levels of strength at 100% elongation and residual strain as achieved in Comparative Examples. A disposable diaper was made using each of the stretch nonwoven fabrics of Examples as an exterior sheet. The resulting diaper was soft to the touch and highly breathable. It stretched well, helping easy diapering. Since the diaper tightened the wearer's body as a whole, it hardly left indentations or marks on the wearer's skin.

A cross-section of the nonwoven fabrics obtained in Examples and Comparative Examples was observed with an SEM. It was confirmed in every nonwoven fabric that the fibers of the elastic fiber layer and the fibers of the inelastic fiber layer were thermal bonded to each other so that these layers were joined all over their contacting surfaces. It was also confirmed that part of the fibers of the inelastic fiber layer entered into the thickness of the elastic fiber layer. The fibers of the elastic fiber layer were found kept in a fibrous form. In addition, the inelastic fibers in the nonwoven fabrics of Examples had their thickness varied periodically. In the comparative nonwoven fabrics, in contrast, not a few thermal bonds of the inelastic fibers were found destroyed.

INDUSTRIAL APPLICABILITY

The invention described herein provides a stretch nonwoven fabric exhibiting both high elongation and high strength. Therefore, the stretch nonwoven fabric of the invention hardly breaks when stretched. The stretch nonwoven fabric of the invention feels good owing to the inelastic fibers with a varied thickness.

The invention claimed is:

1. A stretch nonwoven fabric comprising elastic fibers and inelastic fibers, the inelastic fibers having a varied thickness along the length thereof;

wherein the inelastic fiber has the thickness thereof varied periodically; and wherein the inelastic fiber has a thickness of 2 to 15 μm at the finest portion and of 10 to 30 μm at the thickest portion.

2. The stretch nonwoven fabric according to claim 1, comprising an elastic fiber layer containing the elastic fibers and an inelastic fiber layer containing the inelastic fibers disposed on at least one side of the elastic fiber layer.

3. The stretch nonwoven fabric according to claim 1, comprising an elastic fiber layer containing the elastic fibers and the inelastic fibers.

4. The stretch nonwoven fabric according to claim 1, wherein the inelastic fiber is a conjugate staple fiber.

5. The stretch nonwoven fabric according to claim 1, wherein the inelastic fiber is obtained from a precursor fiber having an elongation of 80% to 800%.

6. The stretch nonwoven fabric according to claim 1, wherein the inelastic fiber has a higher interfiber thermal bond strength than its tensile strength at 100% elongation.

7. The stretch nonwoven fabric according to claim 1, wherein the fibers are thermally bonded to one another by through-air technique.

8. The stretch nonwoven fabric according to claim 1, wherein the inelastic fibers are the result of drawing a stretch nonwoven fabric precursor containing precursor fibers of the inelastic fibers thereby to draw the precursor fibers, and the ratio of the tensile strength of the stretch nonwoven fabric to the tensile strength of the stretch nonwoven fabric precursor is 0.3 to 0.99.

9. The stretch nonwoven fabric according to claim 2, having the elastic fiber layer and the inelastic fiber layer disposed on at least one side of the elastic fiber layer, wherein the elastic fiber in the elastic fiber layer comprises a block copolymer including 10% to 50% by weight of a polymer block A derived predominately from an aromatic vinyl compound and a polymer block B derived predominately from a repeating unit represented by formula (1):

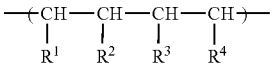

(1)

wherein one or two of $R^1$, $R^2$, $R^3$, and $R^4$ represents or each represent a methyl group; and the others each represent a hydrogen atom, the block copolymer having a storage modulus G' of dynamic viscoelasticity of $1\times10^4$ to $8\times10^6$ Pa and a dynamic loss tangent tanδ of dynamic viscoelasticity of 0.2 or less both measured at 20° C. and a frequency of 2 Hz.

10. The stretch nonwoven fabric according to claim 9, wherein the polymer block B further includes 20 mol % or less of a repeating unit represented by formula (2):

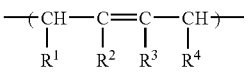

(2)

wherein $R^1$, $R^2$, $R^3$, and $R^4$ are as defined above.

11. The stretch nonwoven fabric according to claim 9, wherein the block copolymer has an A-B-A configuration.

12. The stretch nonwoven fabric according to claim 9, wherein the elastic fiber is continuous fiber.

13. A process of producing a stretch nonwoven fabric, which comprises the steps of:

superposing a web which contains low-drawn, inelastic fibers having an elongation of 80% to 800% on at least one side of a web which contains elastic fibers, applying hot air to the webs by through-air technique while the webs are in a non-united state to obtain a fibrous sheet having the webs united together by thermal bonding of the fibers at the fiber intersections, stretching the fibrous sheet in at least one direction to draw the low-drawn inelastic fibers, and releasing the fibrous sheet from the stretched state;

wherein a first corrugated roller and a second corrugated roller are configured such that large-diameter segments of the first corrugated roller fit with clearance into recesses between every adjacent large-diameter segment of the second corrugated roller and that the large-diameter segments of the second corrugated roller fit with clearance into recesses between every adjacent large-diameter segment of the first corrugated roller; and wherein the fibrous sheet is introduced into a nip between the first and second corrugated roller to be stretched.

14. A process of producing a stretch nonwoven fabric, which comprises the steps of:

applying hot air to a web which contains elastic fibers and low-drawn, inelastic fibers having an elongation of 80% to 800, by through-air technique to obtain a fibrous sheet having the fibers thermally bonded to one another at their intersections, stretching the fibrous sheet in at least one direction to draw the low-drawn inelastic fibers, and releasing the fibrous sheet from the stretched state;

wherein a first corrugated roller and a second corrugated roller are configured such that large-diameter segments of the first corrugated roller fit with clearance into recesses between every adjacent large-diameter segment of the second corrugated roller and that the large-diameter segments of the second corrugated roller fit with clearance into recesses between every adjacent large-diameter segment of the first corrugated roller; and wherein the fibrous sheet is introduced into a nip between the first and second corrugated roller to be stretched.

15. The stretch nonwoven fabric according to claim 1, wherein the inelastic fiber has the thickness varied stepwise.

* * * * *